United States Patent [19]

Ichikawa et al.

[11] Patent Number: 4,730,175

[45] Date of Patent: Mar. 8, 1988

[54] POLARIZED ELECTROMAGNET DEVICE

[75] Inventors: Haruo Ichikawa; Takato Hirota, both of Kanagawa, Japan

[73] Assignee: Fuji Electric Co., Ltd., Kanagawa, Japan

[21] Appl. No.: 46,451

[22] Filed: May 6, 1987

[30] Foreign Application Priority Data

Jun. 2, 1986 [JP] Japan ..... 61-127655

[51] Int. Cl.[4] ..... H01F 7/08

[52] U.S. Cl. ..... 335/230; 335/85; 335/234; 335/79

[58] Field of Search ..... 335/78, 79, 84, 85, 335/229, 230, 234

[56] References Cited

U.S. PATENT DOCUMENTS 4,451,808 5/1984 Koehler ..... 335/230 X 4,604,599 8/1986 Koehler ..... 335/234 X

*Primary Examiner*—George Harris

*Attorney, Agent, or Firm*—Finnegan, Henderson, Farabow, Garrett and Dunner

[57] ABSTRACT

A polarized electromagnet device is constructed with a magnetic block movable within a specially designed yoke in response to the attraction forces of permanent magnets and an electromagnetic coil. The movable block and yoke designs form magnetic circuits which result in a relatively large permanent magnet attraction forces on the attraction side of the device and relatively small permanent magnet attraction force on the return side such that a spring load on the return side is not required.

5 Claims, 7 Drawing Figures

POLARIZED ELECTROMAGNET DEVICE

FIELD OF THE INVENTION

The present invention relates to a polarized electromagnet device in which a movable block is driven by the composite attraction force of permanent magnets and an electromagnetic coil. More particularly, the present invention relates to a polarized electromagnet device which is constructed so that the effect of the attraction force of the permanent magnets is relatively large on the attraction side but sufficiently small on the return side such that a spring load on the return side is not necessary.

BACKGROUND OF THE INVENTION

A conventional polarized electromagnet device, as shown in FIG. 1, is of four-magnetic-gap type. In FIG. 1, reference numeral 1 designates two outer yokes which are substantially U-shaped. Each outer yoke 1 is made up of a central piece 1*a* and leg pieces 1*b* extending from the central piece 1*a* on both sides. The central portion of each central piece 1*a* is in contact with the magnetic pole surface of the north pole of a permanent magnet 2, and the magnetic pole surface of the south pole of each permanent magnet 2 is in turn in contact with the central piece 3*a* of an inner yoke 3, to form a stationary side. The inner yokes 3 are L shaped, and made up of a central piece 3*a* and a leg piece 3*b*.

A magnetic coil 4 is provided inside the inner yokes 3, and is penetrated by a plunger or movable magnetic pole bar 5, as shown in FIG. 1. The ends of the plunger 5 are fixedly secured to the central portions of armatures 6 and 7. Non-magnetic plates 8 are provided on the outer surfaces of the armatures 6 and 7. The plunger, the armatures 6 and 7, and the non-magnetic plates 8 form a movable block which is movable between the legs 1*b* of the outer yoke 1.

FIG. 1 illustrates the configuration of a conventional device in its "return state" when no voltage is applied to the electromagnetic coil 4. In this state the armature 7 and corresponding non-magnetic plate 8 is confronted with the legs 1*b* of the outer yokes 1. Gaps A, B, and C are formed between the armature 6 and the legs 1*b* of the outer yokes 1, between the armature 6 and the legs 3*b* of the inner yokes 3, and between the armature 7 and the end of the central pieces 3*a* of the inner yokes 3, respectively.

When a sufficient voltage is applied to the electromagnetic coil 4 to drive the movable block to an "attraction state" such that armature 6 and corresponding non magnetic plate 8 is confronted with the legs 1*b* on the opposite side of the outer yoke 1, gaps B, C, and D are formed. Gap D corresponds to that spacing created between the armature 7 and the legs of the outer yokes 1.

The solid line arrows in FIG. 1 represent the direction of the magnetic flux of one of the permanent magnets 2. A similar flux pattern exists for the other permanent magnet 2, but is not shown. The X-Y arrow represents the directions in which the movable block may be driven.

FIG. 2 graphically shows the magnetic attraction forces and spring load charcteristics of the conventional polarized electromagnetic device of FIG. 1. In FIG. 2, the horizontal axis represents the stroke of the movable block which corresponds substantially to the length of the magnetic gap A, and the vertical axis represents magnetic attraction forces and spring loads.

The composite attraction force $P'_1$ shown in FIG. 2 with a solid line is the vector composition of the magnetic flux of the permanent magnets 2 and that of the electromagnetic coil 4, acting in the X direction. This composite attraction force $P'_1$ is provided when a rated voltage is applied to the electromagnetic coil 4. Similarly, a composite attraction force $P'_2$ is provided when a minimum allowable voltage (70% of the rated voltage in this example) is applied to the electromagnetic coil 4.

The reference character P'm in FIG. 2 designates the attraction force of permanent magnets 2. The fact that the attraction force of permanent magnets 2 act in the negative direction on the return side indicates that the movable block is urged in the Y direction.

In the conventional device, a spring load $P'_3$ of a return spring (not shown) is applied to the movable block of FIG. 1 in the Y direction at all times. In addition to the spring load $P'_3$, a spring load $P'_4$ provided by a main contact spring and an auxiliary contact spring (both not shown) is also applied to this movable block from the time when the movable block reaches a predetermined position while moving in the X direction.

Spring load $P'_3$ is shown graphically by a broken line in FIG. 2. The cumulative effect of these forces is represented by a composite spring load $P'_5$ on the attraction side. Spring load $P'_5$ is shown in FIG. 2 by a one-dot chain line.

In order that the conventional polarized electromagnet device will operate effectively as an electromagnetic contactor, the composite spring load $P'_5$ must be lower than the composite attraction force $P'_2$. The attraction force P'm of the permanent magnets acts greatly in the negative side, i.e., in the Y direction on the return side. In the device shown in FIG. 1, however, the composite attraction force $P'_2$ is smaller than the spring load $P'_3$ of the return spring, and is insufficient to urge the movable block towards the attraction side. Therefore, in the conventional polarized electromagnet device, a spring load $P'_X$ must be added in the operating X direction so that the composite spring load $P'_5$, as indicated by the one dot chain line in FIG. 2, will become lower than the composite attraction force $P'_2$.

As is apparent from the above description, the conventional polarized electromagnet device is disadvantageous in that, when used as an electromagnetic contactor, its spring load characteristic is intricate and its construction is unnecessarily complicated. Another disadvantage of the conventional device is that the contact pressure is low. As can be seen from FIG. 2, the attraction force P'm of permanent magnets 2 acts greatly on the negative side, and therefore the composite attraction force $P'_2$ or $P'_1$ obtained by adding the attraction force of the electromagnetic coil 4 thereto is small.

OBJECTS AND SUMMARY OF THE INVENTION

An object of this invention is a polarized electromagnet device that is made simple in load characteristic by decreasing the permanent magnet attraction force on the return side.

Another object of this invention is a polarized electromagnet device that can be used as a high-sensitivity contactor with increased contact pressure.

In accordance with the purposes of the invention, as embodied and broadly described herein, the polarized electromagnet device of the present invention comprises first and second outer magnetic yoke means; first and second inner magnetic yoke means; a first permanent magnet disposed in an abutting relationship between the first outer and inner yoke means; a second permanent magnet disposed in an abutting relationship between the second outer and inner yoke means; a magnetic coil disposed between the first and second inner yoke means, the coil having a first end and a second end and being adapted to receive a voltage selectively applied thereto; a first non-magnetic plate adjacent to the first and second outer yokes and proximate the first end of the magnetic coil; a second non magnetic plate adjacent to the first and second outer yokes and proximate the second end of the magnetic coil, each of the first and second inner magnetic yoke means including a corresponding portion extending between the second end of the magnetic coil and the second non-magnetic plate; and magnetic block means having a body passing through the magnetic coil, a first end, and a second end, the block means operative between a first state wherein the second end of the block means is in a contacting relationship with the second plate when no voltage is applied to the magnetic coil and a second state wherein the first end of the block means is in a contacting relationship with the first plate when voltage is applied to the magnetic coil, the first and second inner magnetic yoke means in said first state establishing a first magnetic circuit where the magnetic flux flows from the permanent magnets in one direction to the outer yoke means to the block means to the inner yoke means back to the permanent magnets and by a second magnetic circuit where the magnetic flux flows from the permanent magnets in the other direction to the outer yoke means to the inner yoke means back to the permanent magnets.

Additional advantages of the present invention will be set forth in part in the description that follows and in part will be obvious from that description or can be learned by practice of the invention. The advantages of the invention can be realized and obtained by the structure particularly pointed out in the appended claims.

BRIEF DESCRIPTION OF THE DRAWINGS

The accompanying drawings, which are incorporated in and which constitute a part of this specification, illustrate an embodiment of the invention and, together with the description, explain the principles of the invention.

DETAILED DESCRIPTION OF THE INVENTION

Figure 3:
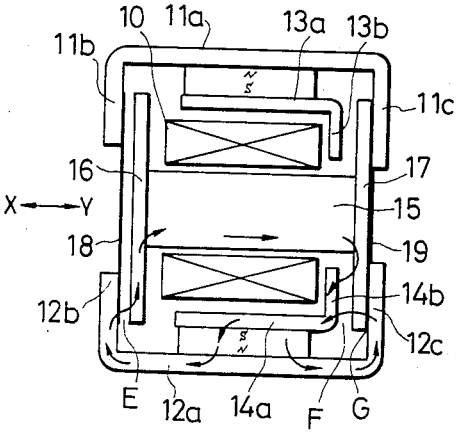
FIGS. 3 and 4 are sectional views showing an embodiment of polarized electromagnet device of the present invention.
Figure 4:
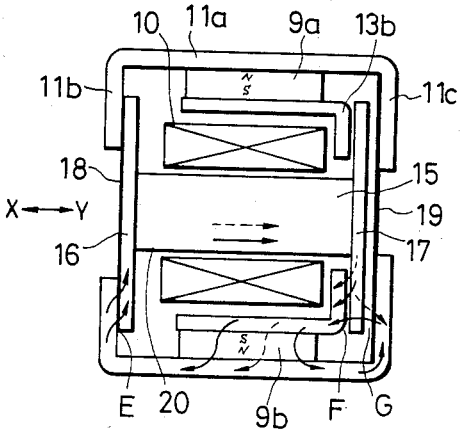

One embodiment of a polarized electromagnet device of the present invention is shown in FIGS. 3 and 4. This device comprises a first outer magnetic yoke 11 and a second outer magnetic yoke 12. Outer yokes 11 and 12 are, for example, substantially U-shaped, and have central portions 11*a* and 12*a* opposite one another. Outer yoke 11 has a first leg 11*b* and a second leg 11*c*; outer yoke 12 has a first leg 12*b* and a second leg 12*c*. Permanent magnets 9*a* and 9*b* are disposed with the north faces of these magnets abutting the interior edge of outer yoke central portions 11*a* and 12*a*, respectively.

The device of FIGS. 3 and 4 also comprises a first inner magnetic yoke 13 and second inner magnetic yoke 14. Inner yokes 13 and 14 are, for example, substantially L-shaped, having central portions 13*a* and 14*a* and legs 13*b* and 14*b*, respectively. Inner yoke central portion 13*a* abuts the south face of permanent magnet 9*a* such that leg 13*b* extends from the end of central portion 13*a* nearest to outer yoke leg 11*c* and in the same direction as leg 11*c*. Inner yoke central portion 14*a* abuts the south face of permanent magnet 9*b* such that leg 14*b* extends from the end of central portion 14*a* nearest to outer yoke leg 12*c* and in the same direction as leg 12*c*.

In the preferred embodiment, the end of central portions 13*a* nearest to outer yoke leg 11*b* is substantially aligned with the end of permanent magnet 9*a* nearest to leg 11*b*; the end of central portion 14*a* nearest to outer yoke leg 12*b* is substantially aligned with the end of permanent magnet 9*b* nearest to leg 12*b*. U-shaped inner yokes 13 can also be formed by using two L-shaped units.

Magnetic coil 10 is disposed between inner yokes 13 and 14. A non-magnetic plate 18 is secured to outer yoke legs 11*b* and 12*b* on the interior edges of legs 11*b* and 12*b*. Another non magnetic plate 19 is secured to the interior edges of outer yoke legs 11*c* and 12*c*.

The device of FIGS. 3 and 4 also comprise a block means 20. As embodied herein the block means 20 includes a body that passes through the magnetic coil 10, and is configured so as to be able to operate between a return state wherein one end of the block means is in contact with non-magnetic plate 19 when no voltage is applied to magnetic coil 10 and an attraction state wherein the other end of the block means is in contact with non magnetic plate 18 when voltage is applied to magnetic coil 10.

In the preferred embodiment, block means 20 comprises a plunger or movable magnetic pole bar 15 passing through magnetic coil 10, a first magnetic armature 16 on the end of the bar 15 nearest to the plate 18 and a second magnetic armature 17 on the end of the bar 15 nearest to the plate 19. Movement of the armature 17 is confined to the passageway bounded by the inner yoke legs 13*b* and 14*b* on one side and a plate 19 and the outer yoke legs 11*c* and 12*c* on the other side. This is unlike the construction of the prior art which has the legs of the inner yokes disposed on the attraction side and which has the return side armature confined only by the outer yoke and the ends of the magnetic coil or the central inner yokes.

Figure 5:
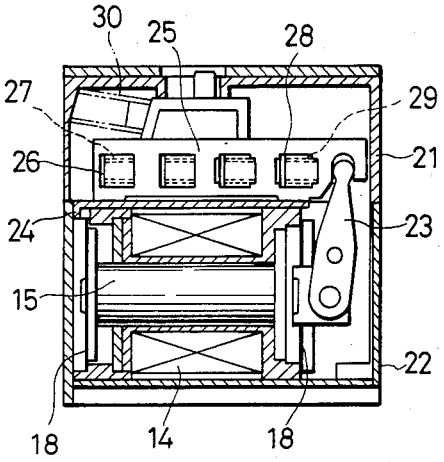
FIGS. 5 and 6 are sectional views showing one embodiment of a high sensitivity contactor utilizing an embodiment of the polarized electromagnet device of the present invention.
Figure 6:
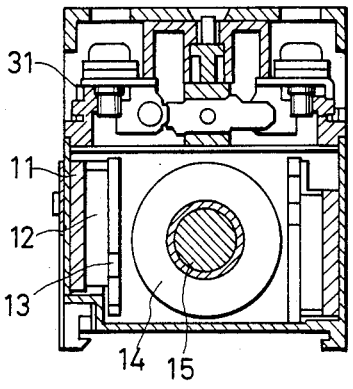

FIGS. 5 and 6 show one example of a high sensitivity contactor to which the polarized electromagnet device of the present invention is applied. The contactor of FIGS. 4 and 5 is made of a contact mechanism and the polarized electromagnet device of FIGS. 3 and 4 discussed above. The contact mechanism is accommodated in an upper casing 21, and the polarized electromagnet is in a lower casing 22. The contact mechanism and the polarized electromagnet device are coupled through a lever 23 to each other, but partitioned with an insulating plate 24 from each other.

The contact mechanism has a supporting member 25 which is coupled to the lever 23. In a contactor having, for example, a main contact with three poles, three movable contacts 26 with corresponding contact springs 27, and one auxilliary movable contact 28 with a contact spring 29, are mounted on the supporting member 25. As shown in FIG. 6, stationary contacts 31, with which movable contacts 26 and 28 are brought into contact, are also provided in the upper casing 21.

In this embodiment, the movable block is urged in the X direction through supporting member 25 and the lever 23 by a return spring 30 at all times. A load in the X direction is added to this spring load by the three contact springs 27 and the auxilliary contact spring spring 29, as supporting member 25 is moved in the X direction.

The operation of the high sensitivity contactor utilizing the polarized electromagnet device of the present invention will be described with reference to FIGS. 3 and 4. FIG. 3 illustrates the preferred embodiment in the return state, and FIG. 4 illustrates the preferred embodiment in the attraction state. As shown in these figures, magnetic gaps E, F, and G are formed between the block means 20 and the inner and outer yokes. More specifically, magnetic gap E is provided between armature 16 and outer yoke legs **11*b* and 12*b*, magnetic gap F is provided between armature 17 and inner yoke legs 13*b* and 14*b*, and magnetic gap G is provided between armature 17 and outer yoke legs 11*c* and 12*c***.

Figure 7:
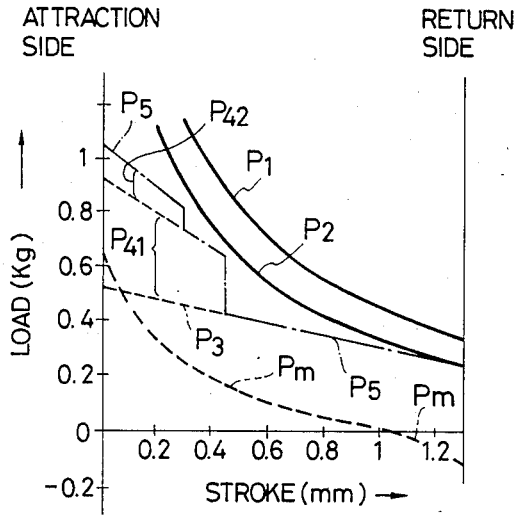
FIG. 7 is a diagram illustrating the magnetic attraction characteristics and spring load characteristics of the embodiment shown in FIGS. 3 and 4.

As discussed above, FIG. 3 shows a return state of the device in which no voltage is applied to electromagnetic coil 10. In this state, the magnetic attraction force produced by, for example, the magnetic flux of permanent magnet **9*b* is indicated by the solid line arrows. For convenience, the magnetic attraction force produced by the magnetic flux of permanent magnet 9*a* is omitted. FIG. 7** indicates the magnetic attraction force and spring load characteristics of the high-sensitivity contactor according to this embodiment of the invention.

In the return state shown in FIG. 3, the attraction force Pm of permanent magnet **9*b* is provided by a magnetic circuit forming a loop between permanent magnet 9*b*, outer yoke 12, magnetic gap E, movable block 20, and magnetic gap F and by a second magnetic circuit forming a loop between permanent magnet 9*b*, outer yoke 12, magnetic gap G, and inner yoke 14. In this configuration, the attraction force Pm of permanent magnets 9*a* and 9*b*** can be represented by the equation $Pm=P_E+P_F-P_G$, where $P_E$, $P_F$, and $P_G$ are the attraction forces provided in the magnetic gaps E, F, and G, respectively.

Figure 1:
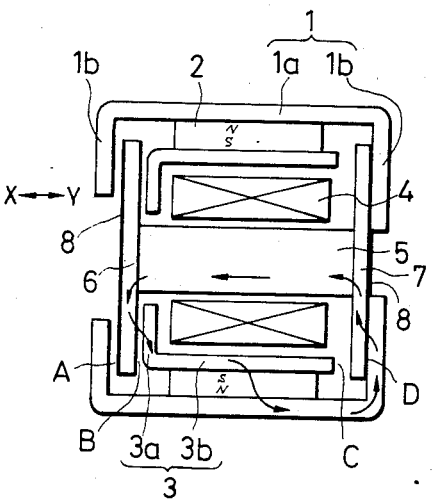
FIG. 1 PRIOR ART
FIG. 1 is a sectional view showing the construction of a conventional polarized electromagnet device.
Figure 2:
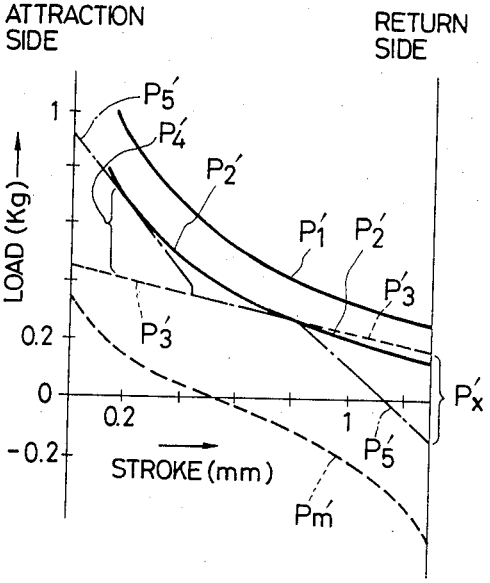
FIG. 2 PRIOR ART
FIG. 2 is a diagram illustrating the magnetic attraction characteristics and spring load characteristics of the polarized electromagnet device shown in FIG. 1.

As shown in FIG. 7, the attraction force Pm acts slightly in the Y direction. Reference characters $P_1$ and $P_2$ correspond to $P'_1$ and $P'_2$ of FIG. 2, respectively. The composite spring load $P_5$ is the sum of the spring load $P_3$ of the return spring 30, the spring load $P_{41}$ of the three contact springs 27, and the spring load $P_{42}$ of the auxilliary contact spring 29.

When energized, the electromagnetic coil 10 forms magnetic flux such that the composite attraction force $P_2$ (or $P_1$) of the permanent magnets **9*a* and 9*b* and the electromagnetic coil 10 becomes larger than the composite spring load $P_5$. Accordingly, the polarized electromagnet device is placed in the attraction state as shown in FIG. 4. In the attraction state of FIG. 4, in addition the the magnetic circuits shown in FIG. 3 there is an additional magnetic circuit forming a loop between outer yoke 12, magnetic gap E, movable block 20**, and magnetic gap G, as shown by the broken line arrows. For convenience, only the magnetic flow in the bottom half of the device is shown. The composite attraction force $P_2$ (or $P_1$) is the composition of the attraction forces $P'_E$, $P'_F$, and $P'_G$ ($P'_E$ $P_E$, $P'_F$ $P_F$, and $P'_G$ $P_G$) provided respectively in the magnetic gaps E, F, and G. That is, $P_2=P'_E+P'_F-P'_G$.

As is apparent from FIG. 7, when compared with the characteristic of the attraction force P'm of the permanent magnets in the conventional polarized electromagnet device, the characteristic of the attraction force Pm of the permanent magnets of the present invention is such that the attraction force is large on the attraction side but small on the return side. This is due, in part, to the the presence of the inner yoke legs **13*b* and 14*b*** on the return side of the device. Accordingly, in the device of the present invention, unlike the conventional device, it is unnecessary to add spring load $P_x$ on the return side. This greatly simplifies the construction of the device. Furthermore, in the device of the present invention, the permanent magnet attraction force is increased on the attraction side, and accordingly the composite attraction force characteristic $P_2$ is greatly increased on the attraction side, to provide a high contact pressure.

The invention in its broader aspects is, therefore, not limited to the specific details and illustrated examples shown and described. Accordingly, it is intended that the present invention cover such modifications and variations, provided that they fall within the scope of the appended claims and their equivalents.

What is claimed is:

1. A polarized electromagnet device comprising first and second outer magnetic yoke means;

first and second inner magnetic yoke means;

a first permanent magnet disposed in an abutting relationship between said first outer and inner yoke means;

a second permanent magnet disposed in an abutting relationship between said second outer and inner yoke means;

a magnetic coil disposed between said first and second inner yoke means, said coil having a first end and a second end and being adapted to receive a voltage selectively applied thereto;

a first non-magnetic plate adjacent to said first and second outer yokes and proximate said first end of said magnetic coil;

a second non-magnetic plate adjacent to said first and second outer yokes and proximate said second end of said magnetic coil, each of said first and second inner magnetic yoke means including a corresponding portion extending between said second end of said magnetic coil and said second non-magnetic plate; and magnetic block means having a body passing through said magnetic coil, a first end, and a second end, said block means operative between a first state wherein said second end of said block means is in a contacting relationship with said second plate when no voltage is applied to said magnetic coil and a second state wherein said first end of said block means is in a contacting relationship with said first plate when voltage is applied to said magnetic coil, said first and second inner magnetic yoke means in said first state establishing a first magnetic circuit where the magnetic flux flows from said permanent magnets in one direction to said outer yoke means to said block means to said inner yoke means back to said permanent magnets and a second magnetic circuit where the magnetic flux flows from said permanent magnets in the other direction to said outer yoke means to said inner yoke means back to said permanent magnets.

2. The device of claim 1, wherein in said second state said first and second inner magnetic yoke means establish said first and second magnetic circuits of said first state and a third magnetic circuit where the magnetic flux flows from said permanent magnets in said one direction to said outer yoke means to said block means to said outer yoke means.

3. A polarized electromagnet device comprising first and second outer magnetic yoke means;

first and second inner magnetic yoke means;

a first permanent magnet disposed in an abutting relationship between said first outer and inner yoke means;

a second permanent magnet disposed in an abutting relationship between said second outer and inner yoke means;

a magnetic coil disposed between said first and second inner yoke means;

a first non-magnetic plate adjacent to said first and second outer yokes;

a second non-magnetic plate adjacent to said first and second outer yokes;

magnetic block means having a body passing through said magnetic coil, a first end, and a second end, said block means operative between a first state wherein said second end of said block means is in a contacting relationship with said second plate when no voltage is applied to said magnetic coil and a second state wherein said first end of said block means is in a contacting relationship with said first plate when voltage is applied to said magnetic coil; and wherein said first inner yoke means has a base portion abutting said first permanent magnet and a leg portion substantially perpendicular to said base portion, said leg portion extending toward said block means from the second block means end of said base portion;

said second inner yoke means has a base portion abutting said second permanent magnet and a leg portion substantially perpendicular to said base portion, said leg portion extending toward said block means from the second block means end of said base portion;

said first state of said block means is characterized by a first magnetic gap between said first plate and said first end of said block means and by a second magnetic gap between said leg portions of said first and second inner yoke means and said second end of said block means; and said second state of said block means is characterized by a third magnetic gap between said leg portions of said first and second inner yoke means and said second end of said block means and by a fourth magnetic gap between said second end of said block means and said second plate.

4. A polarized electromagnet device comprising first and second U-shaped outer magnetic yokes each having an interior central edge bounded in a first direction by a first interior leg edge and bounded in a second direction by a second interior leg edge, said first and second interior leg edges extending at substantially right angles to said interior central portion;

a first permanent magnet having a first magnetic pole surface, a second magnetic pole surface, and an end in said first direction, said first magnetic pole surface abutting said interior central edge of said first outer yoke;

a second permanent magnet having a first magnetic pole surface, a second magnetic pole surface, and an end in said first direction, said first magnetic pole surface abutting said interior central edge of said second outer yoke;

a first inner magnetic yoke having a central portion bounded in said first direction by a first end and bounded in said second direction by a leg portion, said central portion abutting said second magnetic pole surface such that said first direction end of said inner yoke is essentially aligned with said first direction end of said first magnet and said leg portion extending from said second direction end of said central portion in substantially the same direction as said second interior leg edge of said first outer yoke extends from said interior central edge of said first outer yoke;

a second inner magnetic yoke having a central portion bounded in said first direction by a first end and bounded in said second direction by a leg portion, said central portion abutting said second magnetic pole surface such that said first direction end of said inner yoke is essentially aligned with said first direction end of said second magnet and said leg portion extending from said second direction end of said central portion in substantially the same direction as said second interior leg edge of said second outer yoke extends from said interior central edge of said second outer yoke;

a magnetic coil disposed between said first and second inner yokes;

a first non-magnetic plate, said first plate abutting said first interior leg edges of said first and second outer yokes;

a second non-magnetic plate, said second plate abutting said second interior leg edges of said first and second outer yokes; and block means comprising a magnetic pole bar passing through said magnetic coil and having a first end in said first direction and a second end in said second direction, a first magnetic armature at said first direction end of said bar, and a second magnetic armature at said second direction end of said bar and disposed within the passageway created between said first leg portions of said first and second inner yokes and said second plate, said block means operative between a return state wherein said second armature is in a contacting relationship with said second plate when no voltage is applied to said magnetic coil and an attraction state wherein said first armature is in a contacting relationship with said first plate when voltage is applied to said magnetic coil.

5. A polarized electromagnet device comprising first and second U-shaped outer magnetic yokes each having an interior central edge bounded in a first direction by a first interior leg edge and bounded in a second direction by a second interior leg edge, said first and second interior leg edges extending at substantially right angles to said interior central portion;

a first permanent magnet having a first magnetic pole surface, a second magnetic pole surface, and an end in said first direction, said first magnetic pole surface abutting said interior central edge of said first outer yoke;

a second permanent magnet having a first magnetic pole surface, a second magnetic pole surface, and an end in said first direction, said first magnetic pole surface abutting said interior central edge of said second outer yoke;

a first inner magnetic yoke having a central portion bounded in said first direction by a first end and bounded in said second direction by a leg portion, said central portion abutting said second magnetic pole surface such that said first direction end of said inner yoke is essentially aligned with said first direction end of said first magnet and said leg portion extending from said second direction end of said central portion in substantially the same direction as said second interior leg edge of said first outer yoke extends from said interior central edge of said first outer yoke;

a second inner magnetic yoke having a central portion bounded in said first direction by a first end and bounded in said second direction by a leg portion, said central portion abutting said second magnetic pole surface such that said first direction end of said inner yoke is essentially aligned with said first direction end of said second magnet and said leg portion extending from said second direction end of said central portion in substantially the same direction as said second interior leg edge of said second outer yoke extends from said interior central edge of said second outer yoke;

a magnetic coil disposed between said first and second inner yokes;

a first non-magnetic plate, said first plate abutting said first interior leg edges of said first and second outer yokes;

a second non-magnetic plate, said second plate abutting said second interior leg edges of said first and second outer yokes; and block means comprising a magnetic pole bar passing through said magnetic coil and having a first end in said first direction and a second end in said second direction, a first mag netic armature at said first direction end of said bar, and a second magnetic armature at said second direction end of said bar, said block means operative between a return state when no voltage is applied to said magnetic coil, characterized by a first magnetic gap between said first plate and said first armature, a second magnetic gap between said second leg portions of said first and second inner yokes and said second armature, and a contacting relationship between said second armature and said second plate, and an attraction state when a voltage is applied to said magnetic coil, characterized by a third magnetic gap between said second leg portions of said first and second inner yokes and said second armature, a fourth magnetic gap between said second armature and said second plate, and a contacting relationship between said first armature and said first plate.

* * * * *